United States Patent [19]

Hessari

[11] 4,303,124

[45] Dec. 1, 1981

[54] PLATE HEAT EXCHANGER

[75] Inventor: Manouchahr F. Hessari, Brighton, England

[73] Assignee: The A.P.V. Company Limited, Crawley, England

[21] Appl. No.: 156,097

[22] Filed: Jun. 3, 1980

[30] Foreign Application Priority Data

Jun. 4, 1979 [GB] United Kingdom ..... 19339/79
Jul. 3, 1979 [GB] United Kingdom ..... 23178/79

[51] Int. Cl.[3] ..... F28F 3/00; F28F 9/22
[52] U.S. Cl. ..... 165/167; 165/174
[58] Field of Search ..... 165/166, 167, 174

[56] References Cited

U.S. PATENT DOCUMENTS 1,958,899 5/1934 MacAdams ..... 165/174
4,153,106 5/1979 Sonoda et al. ..... 165/174

FOREIGN PATENT DOCUMENTS 160689 10/1957 Sweden ..... 165/174
962753 7/1964 United Kingdom ..... 165/174

*Primary Examiner*—Sheldon J. Richter
*Attorney, Agent, or Firm*—Christel, Bean & Linihan

[57] ABSTRACT

In a plate heat exchanger, particularly with a large number of plates in a pass, one of the problems is the port losses arising from uneven distribution between the flow spaces in the pass. In accordance with the present invention in order to divert flow away from the inlet and outlet end of a U arrangement pass, there is provided in the inlet duct a distribution (9) in the form of a tube (12) having external fins (15) an external annulus (17) and a flow straightening extension (18) mounted on locating rods (13*a*). In the discharge duct there is provided a collector (11) also in the form of tubes having an inlet aperture (23) and an external annulus (22).

14 Claims, 9 Drawing Figures

PLATE HEAT EXCHANGER

This invention relates to plate heat exchangers.

A plate heat exchanger, as the term is normally understood, includes a separable pack of gasketed plates arranged in spaced, face-to-face relationship to define flow spaces between adjacent plates. The plates have aligned holes or ports which form ducts for the supply and discharge of media, the gasketing being so arranged that the supply and discharge ducts of one medium are in communication with alternate flow spaces while those of the other medium are in communication with the intervening flow spaces.

The plates are normally pressed out from sheet of corrosion-resistant material such as stainless steel or titanium.

One problem arising with plate heat exchangers, particularly with large numbers of plates in a pass in that the flow of either or both media will not be evenly distributed between the flow spaces arranged in parallel. This phenomenon is known as port losses and leads to deviation from designed performance and possible damage to feed liquids, e.g. food liquids, which may be vulnerable to thermal degradation. The under-use of particular flow spaces leads to an unnecessarily high pressure drop across the heat exchanger, with consequent wastage of power or reduction in flow.

The nature of the maldistribution varies with the arrangement. With a symmetric or U arrangement, in which the flow feed and discharge for the medium in question are at the same end of the pack of plates forming the pass, the easier flow path, which is therefore preferentially used, is in flow passages nearer the feed and discharge end. In an asymmetric or Z arrangement a different problem arises.

In order to understood the distribution in the ports or ducts of a plate heat exchanger it is necessary to envisage each duct as a very rough pipe. This gives rise to an effect of a pressure drop along the length of the inlet duct away from the feed end and along the length of the discharge duct towards the discharge end. In addition there is the momentum effect arising from the change in fluid flow rate, i.e. a drop in the flow rate in the inlet duct in the direction away from the inlet end and a rise in the flow rate in the discharge duct towards the discharge end. The variations in pressure due to these effects are in opposite directions in the inlet duct giving rise to a difference effect. However, they are in the same direction in the discharge duct giving arise to an additive effect.

The net result of this in a U arrangement (symmetric) of plates is a fairly constant, either slightly falling or rising, pressure along the inlet duct away from the feed end. In the discharge duct the pressure falls sharply towards the outlet end, which is the same as the feed end of the inlet duct. Accordingly, the greatest pressure drop is near the feed and discharge end of the pack, so that flow is preferentially taking place at and near that end of the pack and the flow spaces at the other end are partially starved. With heat exchangers having a comparatively small number of plates, i.e. up to a few dozen, this is perhaps not as significant as it is with a large number of plates in a pass, e.g. some hundreds.

The present invention is directed to a solution of the distribution problem in plate heat exchangers of the U or symmetrical arrangement.

According to the present invention there is provided a plate heat exchanger comprising a pack of plates arranged in spaced face-to-face relationship to define flow spaces between adjacent plates, the plates having aligned holes therein which form ducts for the supply and discharge of media to and from the flow spaces, the arrangement of the ducts for at least one medium being of symmetric or U arrangement with the supply and discharge ducts being fed from and discharged to the same end of the pack, in which an insert is provided in the supply duct for the said at least one medium to assist in distribution of the medium along the pack of plates by increasing the flow to the flow spaces near the end of the pack remote from the inlet end of the supply duct.

The function of the insert is basically to provide limited restriction to the access of medium to the flow spaces nearer the inlet end and to provide easier flow paths to the flow spaces remote from the feed end. A preferred form of insert includes a tube generally coaxial with the duct to provide a limited space outside the tube to feed the nearer flow spaces and a substantially larger flow feed to the further flow spaces beyond the end of the tube. The tube may have external longitudinal fins extending part way along the tube from near the inlet end which fins not only support the tube but also serve to partition the flow still further so that an easier flow path is provided for the flow spaces beyond the ends of the fins.

A generally radial annulus may be provided part way along the tube to inhibit back flow from the downstream side thereof. The tube may have a perforation in the region of the annulus to provide an enhanced flow immediately adjacent the annulus.

The tube preferably stops some way short of the end of the duct and may be located by means of longitudinal rods extending between the tube and an end plate.

A short extension band may be provided to straighten the flow between the downstream end of the tube and the end plate to encourage flow to the inner end of the duct.

Since a greater pressure gradient may exist in the discharge duct than in the supply duct a further insert may be provided in the discharge duct to increase the flow rate remote from the outlet end to reduce the pressure gradient and further encourage flow in the flow spaces adjacent the outlet end.

The said further insert may also be in the form of the tube having an inlet aperture in its wall and debouching into the discharge duct towards the outlet end thereof. This tube may have an annulus to inhibit flow along its outside.

It will be appreciated that the actual form of the or each insert will depend on the flow characteristics of the heat exchanger as determined by the operating parameters including number and size of plates, operating pressures, viscosity of media and so forth.

The invention will be further described with reference to the accompanying diagrammatic drawings, in which:

FIG. 1*a* is a diagrammatic illustration of a symmetric or U arrangement plate heat exchanger;

FIG. 1*b* illustrates the pressure gradients in the supply and discharge ducts of a U arrangement;

FIG. 1*c* illustrates the resulting pattern of flow through the flow spaces;

Figure 1A:
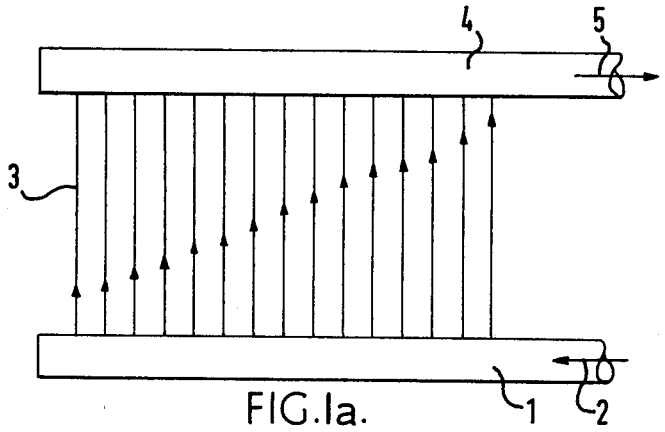
Figure 1B:
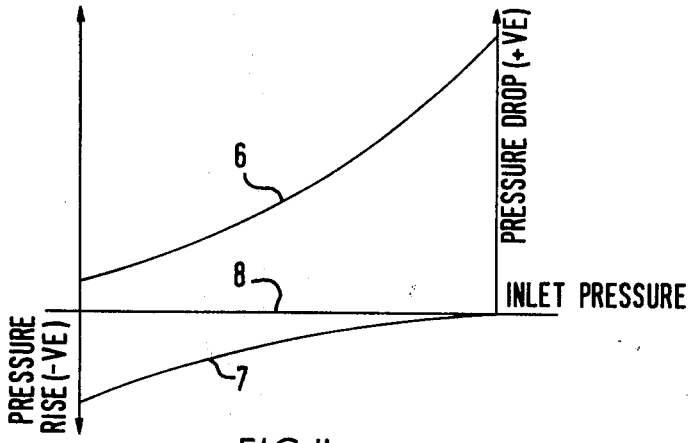
Figure 1C:
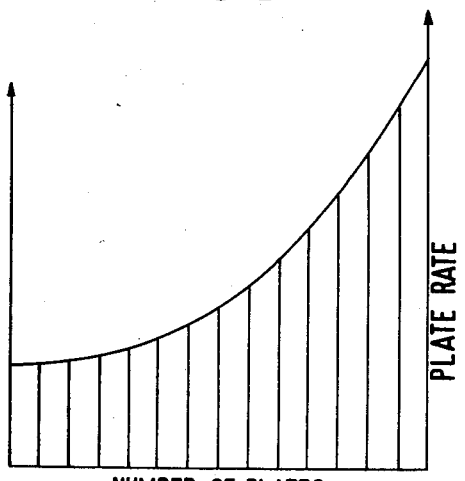

Turning first to FIGS. 1*a*, 1*b* and 1*c*, FIG. 1*a* is a diagram showing the broad outline of the flow arrangement in a typical symmetrically arranged (U arrangement) plate heat exchanger. A medium enters an inlet port 1 in the direction indicated by the arrow 2, passes into the flow spaces arranged in parallel and indicated by the lines 3, and then flows into an outlet port or duct 4 and flows out in the direction indicated by the arrow 5. Only a comparatively small number of flow spaces are indicated by lines 3, and it will be appreciated that a pass may contain some hundreds of plates. Also, it is to be appreciated that the flow spaces for only one medum are shown and these will be interleaved with flow spaces for the other medium. In FIG. 1*b*, the curve 6 illustrates the pressure gradient in the outlet duct 4, with the pressure drop indicated as a positive quantity. The curve 6 shows that the pressure falls, i.e. the pressure drop rises, quite sharply towards the exit end in the direction of the arrow 5 due to the additive effect of the frictional resistance due to the rough pipe characteristics of the duct 4, and the pressure drop due to the increase in flow velocity as greater volumes enter the duct 4, nearer the exit end. The curve 7 shows, on a similar basis, the pressure gradient in the inlet duct 1, using the inlet pressure as a base line 8. As explained above, the pressure drop due to flow resistance and the pressure rise due to the momentum effect act in opposition, so that the curve 7 is less steep than the curve 6 and in fact the pressure at the extreme end of the inlet duct 1 is rather higher than the pressure at the inlet. The difference between the two curves is thus the pressure drop across the flow space itself at that position, and it will be seen that the pressure drop is fairly high near the inlet end and falls to a much lower level at the flow spaces remote from the inlet end. This being the case, the flow rate is much higher in the plates nearer the end, and this is illustrated in FIG. 1*c* which shows a typical distribution of the flow rate as between the low level on the plates at the left hand side and a much higher level than the plates on the right hand side near the inlet and outlet. It will be seen for instance that the flow through the plates is some three to four times as great as that through the plates remote from the inlet.

These data have been derived by experimental measurement, and have been given without dimensions or values since these vary very much with the particular values adopted for the various parameters, but it will be appreciated that the general tendency with a U or symmetrical arrangement is similar.

Figure 2:
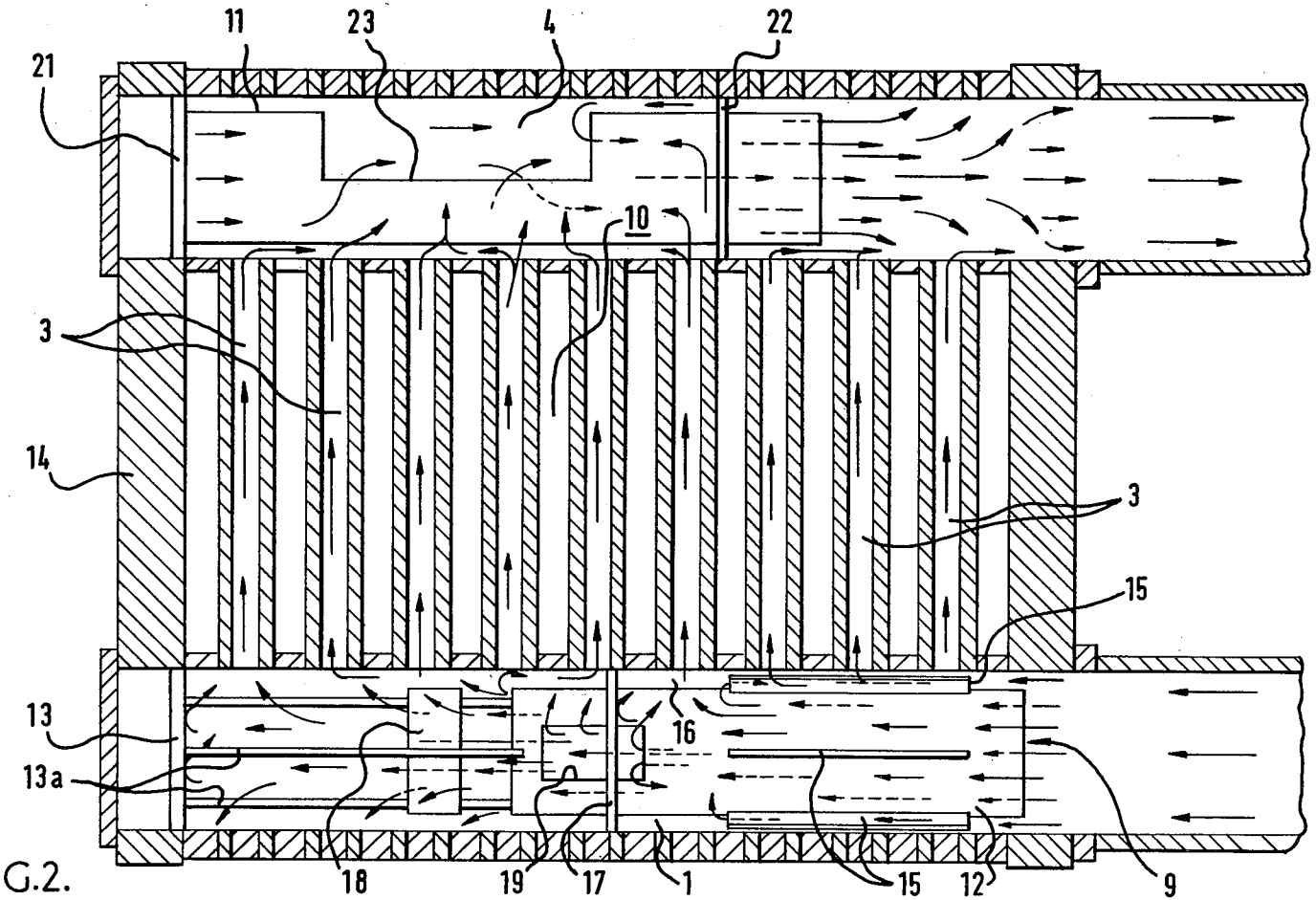
FIG. 2 is a sectional view showing inserts in the supply and discharge ducts of a U arrangement plate heat exchanger.

FIG. 2 is a diagram showing in section a U plate arrangement with a fairly small number of plates for ease of illustration, and in a practical case the invention is likely to be applied to heat exchangers with a much greater number of plates than the twenty or so illustrated. The inlet duct is again illustrated at 1 and the flow space is connected thereto by 3, the flow in this being indicated by arrows. The outlet duct is shown at 4. The intervening flow spaces are illustrated at 10. FIG. 2 also shows in the inlet duct an insert generally indicated at 9 and illustrated in more detail in FIGS. 3 to 5. In the outlet duct 4 there is shown a flow controlling insert 11 which is illustrated in more detail in FIGS. 6 and 7. The purpose of the inserts 9 and 11 is to change the flow pattern so that the pressure drop over each of the flow spaces 3 is substantially similar, thus leading to a greater utilisation of the available flow capacity of the heat exchanger as a whole and the greater uniformity in the heat transfer. This is done essentially by providing a number of inhibition or restrictions to flow through the flow spaces 3 adjacent the inlet end of the duct 1, and encouragement of flow to the flow spaces remote from that end. These objects are intended to be achieved by the insert 9, which will hereinafter be referred to as a distributor, while the insert 11, which may be termed a collector has the basic object of increasing the flow rate in the outlet duct 4 in the region of those flow spaces remote from the inlet and outlet end so that the pressure drop due to momentum effect is reduced.

Figure 3:
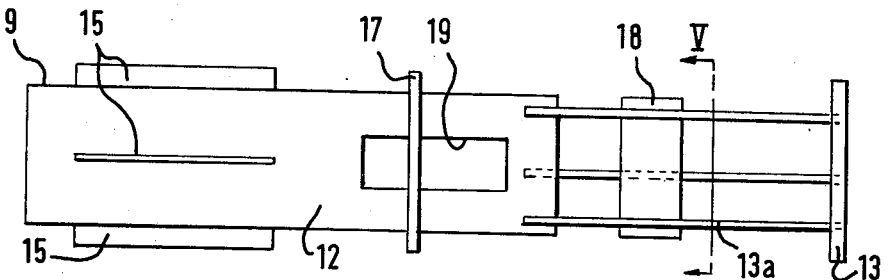
FIG. 3 is an elevation of an insert similar to that shown in the supply duct of FIG. 2.
Figure 4:
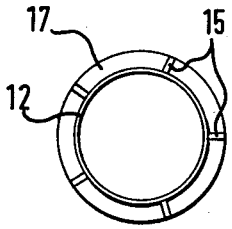
FIG. 4 is an end elevation of the insert of FIG. 3.
Figure 5:
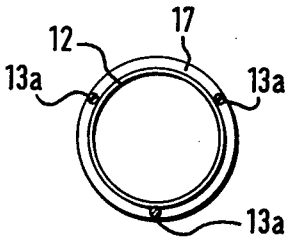
FIG. 5 is a section on the line V—V of FIG. 3.

Turning now also to FIGS. 3 to 5, the distributor 9 will be described in more detail. It will be seen as comprising a cylindrical tube 12 extending from a location near the inlet end of the duct 1 to a point some 3/5th (60%) of the way therealong. Its longitudinal position within the duct 1 is maintained by means of a locating ring 13 secured (by means not shown) to the follower 14 of the heat exchanger. The locating ring 13 is connected to the tube 12 by means of longitudinally extending rods 13*a*. The diameter of the tube 12 is chosen in accordance with the flow requirements, but its essential function is to ensure that a substantial proportion of the fluid flowing into the duct 1 passes along the inside of the tube towards the remote end of the duct, and a smaller proportion passes along the outside of the tube and can hence enter the flow spaces 3 nearer the inlet end. The tube 12 has external radial fins 15, shown as being five in number, and which have two functions of supporting the tube 12 substantially coaxially within the duct 1 and also controlling and partitioning the flow along the outside of the tube 12 so that a proportion of the liquid which initially flows outside the tube is restrained from entering the first few flow spaces and is carried to an annular zone 16 in a substantially central zone of the length of the pack. In order to prevent too much flow back from the open exit end of the tube 12, it is provided on its outside with an annulus 17 which also has some supporting effect. Some of the liquid flowing out of the open end of the tube then flows back towards the annulus 17 and the rest is thrown onward toward the remote end of the pack. In order to ensure that there is still a considerable flow down the centre of the duct 1 after the medium has flowed out of the tube 12, a short extending or flow straightening ring 18 is mounted on the rods 13*a*. Also, in order to prevent undue starvation of the flow spaces immediately adjacent the annulus 17, the tube may be provided with a single slit 19 in the region of the annulus to allow some flow to leave the interior of the tube at that location.

Figure 6:
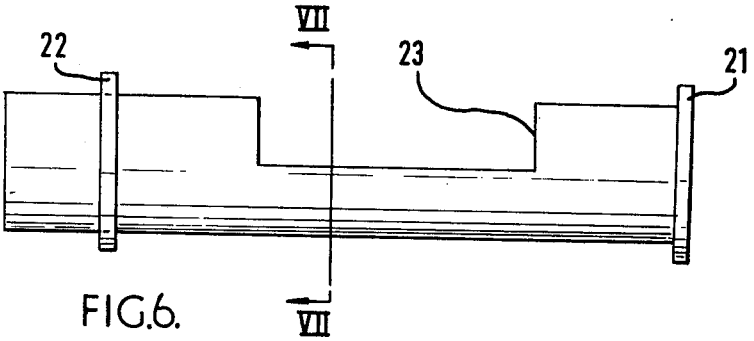
FIG. 6 is an elevation of an insert similar to the insert shown in the discharge duct of FIG. 2.
Figure 7:
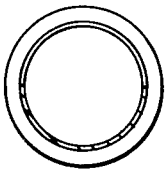
FIG. 7 is a view on the line VII—VII of FIG. 6.

Turning now to FIGS. 6 and 7, which will also to be read in conjunction with FIG. 2, it will be seen that the collector basically comprises a tube extending from the remote end of the outlet duct 4 towards the outlet end. Its closed remote end is attached to a locating ring 21 secured, by means not shown, to the follower 14. The tube occupies a substantial proportion of the total cross-sectional area of the duct 4, and by this means is causes a substantial increase in the actual flow speed of the medium emerging from the flow spaces 3. A support and blocking annulus 22 is mounted on the tube so that the medium passing up certain of the flow spaces 3 is forced to flow in a reverse direction along the duct 3 before entering an opening 23 leading to the interior of the tube. The medium from the last or most remote flow spaces 3 is also caused to flow along the outside of the tube before reaching the opening 23. The flow space or spaces debouching into the duct 4 just on the downstream side of the annulus 22 are also feeding into a restricted space formed around the outside of the tube so that here too the flow speed is increased, and where this flow unites with the flow which has come down the inside of the tube, i.e. in the full cross-sectional area of the duct 4, the flow speed has already reached a fairly high level. In any event, the flow spaces 3 debouching into this zone are those which are normally the least starved.

The use of the distributor 9 and collector 11 thus has a tendency to improve the flow, and also it has been found that the flow within the tubes forming the distributor and collector is less subject to friction with the very uneven surface of the duct, which is formed by the edges of the successive plates and by the gaskets between them.

It has been found that by the improved distribution arising from the use of a distributor and a collector, the overall hydraulic efficiency of the heat exchanger has been improved so that the additional pressure drop overall arising from the introduction of restrictions has been largely, if not wholly, off-set by a reduction in the pressure drop arising from the greater use of those flow spaces which are normally starved.

Various modifications may be made within the scope of the invention. For instance, the slit 19 in the distributor may if desired by extended to the end of the tube 12 downstream of the annulus 17. In some arrangements also, the slit 19 may be omitted completely.

I claim:

1. In a plate heat exchanger comprising a pack of plates arranged in spaced face-to-face relationship to define flow spaces between adjacent plates, the plates having aligned holes therein which form ducts for the supply and discharge of media to and from the flow spaces, the arrangement of the ducts for at least one medium being of symmetric or U arrangement with the supply and discharge ducts being fed from and discharged to the same end of the pack: the improvement that an insert is provided in the supply duct for the said at least one medium to assist in distribution of the medium along the pack of plates by increasing the flow to the flow spaces near the end of the pack remote from the inlet end of the supply duct.

2. A plate heat exchanger as claimed in claim 1, in which the insert is in the form of a tube generally coaxial with the duct to provide a limited space outside the tube to feed the nearer flow spaces and a substantially larger flow feed to the further flow spaces beyond the end of the tube.

3. A plate heat exchanger as claimed in claim 2, in which the tube has external longitudinal fins extending part way along the tube from near the inlet end, which fins not only support the tube but also serve to partition the flow still further so that an easier flow path is provided for the flow spaces beyond the ends of the fins.

4. A plate heat exchanger as claimed in claim 2, in which a generally radial annulus is provided part way along the tube to inhibit back flow from the downstream side thereof.

5. A plate heat exchanger as claimed in claim 4, in which the tube has a perforation in the region of the annulus to provide an enhanced flow adjacent the annulus.

6. A plate heat exchanger as claimed in claim 5, in which the perforation extends to both sides of the annulus.

7. A plate heat exchanger as claimed in claim 5, in which the perforation extends to the end of the tube remote from the inlet end.

8. A plate heat exchanger as claimed in claim 2, in which the tube stops some way short of the end of the duct.

9. A plate heat exchanger as claimed in claim 8, in which the tube is located by means of an end plate mounted in the duct and by longitudinal rods extending between the tube and the end plate.

10. A plate heat exchanger as claimed in claim 9, in which a short extension band is provided to straighten the flow between the downstream end of the tube and the end plate to encourage flow to the inner end of the duct.

11. A plate heat exchanger as claimed in claim 10, in which the short extension band is mounted on the rods.

12. A plate heat exchanger as claimed in claim 1, in which a further insert is provided in the discharge duct to increase the flow rate remote from the outlet end to reduce the pressure gradient and further encourage flow in the flow spaces adjacent the outlet end.

13. A plate heat exchanger as claimed in claim 12, in which the further insert is in the form of a tube having an inlet aperture in its wall and debouching into the discharge duct towards the outlet end thereof.

14. A plate heat exchanger as claimed in claim 13, in which the tube has an annulus to inhibit flow along its outside.

* * * * *